US007677908B2

(12) United States Patent
Sugiyama et al.

(10) Patent No.: US 7,677,908 B2
(45) Date of Patent: Mar. 16, 2010

(54) LEVER-TYPE CONNECTOR

(75) Inventors: Osamu Sugiyama, Makinohara (JP); Masahito Kazuno, Makinohara (JP); Terufumi Hara, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/484,775

(22) Filed: Jun. 15, 2009

(65) Prior Publication Data

US 2009/0311893 A1 Dec. 17, 2009

(30) Foreign Application Priority Data

Jun. 16, 2008 (JP) ..... P2008-156414

(51) Int. Cl.
*H01R 13/62* (2006.01)

(52) U.S. Cl. ..... 439/157

(58) Field of Classification Search ..... 439/157, 439/372, 152, 158

See application file for complete search history.

(56) References Cited

U.S. PATENT DOCUMENTS 6,461,177 B1 * 10/2002 Saka et al. ..... 439/157

2007/0202722 A1 * 8/2007 Sasaki et al. ..... 439/157

FOREIGN PATENT DOCUMENTS

JP 2004-241157 A 8/2004

* cited by examiner

*Primary Examiner*—Phuong K Dinh
(74) *Attorney, Agent, or Firm*—Finnegan, Henderson, Farabow, Garrett & Dunner, L.L.P.

(57) ABSTRACT

A lever type connector comprises a first connector housing; a second connector housing including a projection; and a lever pivotally engaged with the first connector housing and including two arm plates and an interconnecting bar which connects the two arm plates. The each arm plate comprises a provisional-retaining projection projecting from the arm plate toward the other arm plate, which abuts to the projection and causes to deform the arm plate so that the arm plate recedes to the other arm plate when the projection is inserted into the cam groove; and a cancellation lever extending from an edge of the arm plate and positioned at a counter side of the inlet with respect to the pivotal support, which cause to deform the arm plate so that the arm plate recedes to the other arm plate when the cancellation lever is pressed to come close to the other cancellation lever.

9 Claims, 11 Drawing Sheets

LEVER-TYPE CONNECTOR

CROSS-REFERENCE TO RELATED APPLICATIONS

This application claims priority from Japanese Patent Application No. 2008-156414 filed on Jun. 16, 2008, the entire subject matter of which is incorporated herein by reference.

TECHNICAL FIELD

This invention relates to a lever-type connector in which by pivotally moving a lever, male and female connector housings is brought into and out of fitting engagement with each other with a small force.

BRIEF DESCRIPTION OF THE RELATED ART

In the field of connectors such as a multi-pole connector in which a large fitting force is required, a lever-type connector which is provided with a lever for assisting the fitting force has been used.

In such a lever-type connector, a lever having cam grooves is pivotally mounted on one of two connector housings to be fitted together, and engagement pins for engagement respectively in the cam grooves are formed in a projecting manner on the other connector housing. When the two connector housings are initially fitted together, the engagement pins are inserted respectively into inlets of the cam grooves, and in this condition, when the lever is pivotally moved, the engagement pins, while guided by the respective cam grooves, are moved along the respective cam grooves. By doing so, the two connector housings are completely fitted together with a small force, utilizing leverage achieved by the lever.

FIGS. 4 to 7 shows one related lever-type connector disclosed in JP2004-241157A, and more specifically FIG. 4 is a side-elevational view showing a condition before each engagement pin 955 is inserted into a cam groove 940, FIG. 5 is a side-elevational view showing a condition (initially-fitted condition) in which the engagement pin 955 is initially inserted in the cam groove 940, FIG. 6 is a side-elevational view showing a condition in which a lever 930 is initially pivotally moved, and FIG. 7 is a side-elevational view showing a condition (finally-fitted condition) in which the lever 930 is completely pivotally moved to a operated position.

This related lever-type connector comprises a pair of female and male (or first and second) connector housings 910 and 950 to be fitted together, and female metal terminals (not shown) are received respectively in terminal cavities of the connector housing 910, and also male metal terminals (not shown) are received respectively in terminals cavities of the connector housing 950. The lever of a generally U-shaped cross-section for effecting the fitting operation of the connector is mounted on outer side surfaces of the first connector housing 910. The lever 930 includes a pair of parallel spaced, opposed right and left arm plates 931 and 931, and an interconnecting bar (handle) 949 interconnecting the two arm plates 931. A shaft hole 932 serving as a pivotal support portion, as well as the cam groove 940, is formed in each arm plate 931.

The cam groove 940 is formed around the shaft hole 932, and extends through a predetermined angle, and is curved such that the distance from the center (serving as the axis of pivotal movement of the lever) of the shaft hole 932 to the cam groove 940 is gradually decreasing from an inlet 941 of the cam groove 940 toward a terminating end (inner end) of the cam groove 940. Support shafts 912 for being angularly movably fitted in the respective shaft holes 932 are formed on and project respectively from the outer side surfaces of the first connector housing 910. When the shaft holes 932 are fitted respectively on the support shafts 912, the lever 930 is pivotally moved about the support shafts 912 through the predetermined angle between a starting position and a operated position.

The engagement pins 955 for fitting respectively in the cam grooves 940 of the lever 930 are formed on and project respectively from outer side surfaces of the mating second connector housing 950. The lever-type connector is once provisionally assembled, and in this condition each engagement pin 955 is located immediately before (or adjacent to) the inlet 941 of the cam groove 940 of the lever 930 disposed at the starting position.

For fitting the two connector housings together, first, the lever 930 is located at the starting position as shown in FIG. 4. Then, in this condition, the connector housing 910 and the connector housing 950 are initially fitted together as shown in FIG. 5, and by doing so, the engagement pins 955 is inserted respectively in the inlets 941 of the cam grooves 940. In this condition, when the interconnecting bar 949 is grasped, and then the lever 930 is pivotally moved toward the operated position as shown in FIGS. 6 and 7, each engagement pin 955 is moved from the inlet 941 into the cam groove 940, and the connector housing 910 and the connector housing 950 are fitted together through a cam action achieved by the sliding movement between each cam groove 940 and the engagement pin 955.

When the lever 930 is thus pivotally moved to the operated position, the two connector housings 910 and 950 are properly fitted together, and also the male metal terminals are properly connected respectively to the female metal terminals. For disconnecting the two connector housings 910 and 950 from each other, the lever 930 is pivotally moved in the opposite direction. As a result, the fitting connection of the two connector housings 910 and 950 with each other is canceled by reverse leverage acting between each cam groove 940 and the engagement pin 955.

SUMMARY

In the above related lever-type connector, the concept that the two connector housings 910 and 950 are provisionally fixed to each other before they are fitted together is not taken into consideration.

Therefore, even when the two connector housings 910 and 950 are once provisionally assembled together as shown in FIG. 5, the two connector housings 910 and 950 are often disconnected from each other due to application of an external force. When the provisionally-assembled condition is thus canceled, the two connector housings must be again provisionally assembled together before effecting the connector fitting operation, and there is a problem that the fitting operation may be cumbersome.

Therefore, the Applicant of the present invention has thought of an idea that a distal end portion of the lever mounted on the first connector housing is provisionally engaged with the second connector at a stage before the two connector housings are fitted together, thereby provisionally fixing the two connector housings to each other before the lever is pivotally moved.

By doing so, the two connector housings disposed in the provisionally-assembled condition are prevented from being disconnected from each other, and therefore merely by pivotally moving the lever, the two connector housings are easily brought into and out of fitting engagement with each other. A lever-type connector incorporating the above idea is described bellow with reference to FIGS. 8 to 11.

FIG. 8 is a front-elevational view showing the construction of a lever, FIG. 9A is a perspective view showing the construction of a lever, FIG. 9B is an enlarged view of a portion of the lever indicated by IXb of FIG. 9A, FIG. 10 is a front-elevational view showing the process of provisionally engaging distal end portions of arm plates of the lever (mounted on a first connector housing) respectively with engagement pins of a mating second connector housing, and FIG. 11 is a fragmentary enlarged view showing a condition in which the arm plate is provisionally engaged with the engagement pin.

As shown in FIG. 10, this lever-type connector includes a pair of female and male (or first and second) connector housings 20 and 30 to be fitted together, and female metal terminals (not shown) are received respectively in terminal cavities of the first connector housing 20, and also male metal terminals (not shown) are received respectively in terminal cavities of the second connector housing 30.

The lever 100 of a generally U-shaped cross-section for effecting the fitting operation of the connector is mounted on outer side surfaces of the first connector housing 20. The lever 100 includes a pair of right and left arm plates 12 and 12 each having at its one end portion a pivotal support portion 13 for being pivotally supported on the first connector housing 20, and an interconnecting bar (handle) 11 interconnecting the other ends of the two arm plates 12. A shaft hole 14 is formed through a center portion of the pivotal support portion 13 of each arm plate 12, and a cam groove 15 is formed in the arm plate 12, and is disposed around the shaft hole 14.

The cam groove 15 is formed around the shaft hole 14 formed in the center portion of the pivotal support portion 13, and extends through a predetermined angle, and is curved such that the distance from the center (serving as the axis of pivotal movement of the lever) of the shaft hole 14 to the cam groove 15 is gradually decreasing from an inlet 15*a* of the cam groove 15 toward a terminating end (inner end) 15*b* of the cam groove 15.

Support shafts (not shown) for being angularly movably fitted in the respective shaft holes 14 are formed on and project respectively from the outer side surfaces of the first connector housing 20. When the shaft holes 14 are fitted respectively on the support shafts, the lever 100 is able to pivotally moved about the pivotal support portions 13 through the predetermined angle between a starting position and a operated position.

Engagement pins 31 for fitting respectively in the cam grooves 15 of the lever 100 are formed on and project respectively from outer right and left side surfaces of the second connector housing 30. Once the lever-type connector is provisionally assembled, each engagement pin 31 is located in front of (or adjacent to) the inlet 15*a* of the cam groove 15 of the lever 100 disposed at the starting position.

In this lever-type connector, provisionally-retaining projections 16 are formed respectively on inner surfaces of distal end portions of the two arm plates 12 of the lever 100 as shown in FIG. 10, and each provisionally-retaining projection 16 is allowed to slide over the corresponding engagement pin (projecting portion) 31 (formed on the second connector housing 30) because of outward elastic deformation (bending) of the arm plate 12, and is provisionally engaged with the engagement pin 31, with the engagement pin 3 1 received in the inlet 15*a* of the cam groove 15, thereby provisionally fixing the arm plate 12 to the second connector housing 30.

As shown in FIGS. 9B and 10, the provisionally-retaining projection 16 is formed on and projects from that portion of the inner surface of the distal end portion of the arm plate 12 disposed adjacent to the inlet 15*a* of the cam groove 15. An inclined wall (or surface) 16*b* is formed on an outer surface of each provisionally-retaining projection 16, and as the two arm plates 12 are pushed or forced onto the second connector housing 30, each inclined wall 16*b* slides on the engagement pin 31 of the second connector housing 30 to elastically bend the arm plate 12 outwardly. A retaining wall (or surface) 16*a* for retaining the engagement pin 31 slid over the provisionally-retaining projection 16 is formed on an inner surface of the provisionally-retaining projection 16, the retaining wall 16*a* being disposed generally perpendicular to the direction in which the arm plates 12 are pushed onto the second connector housing 30.

For fitting the two connector housings together, first, the lever 100 is located at the starting position. Then, in this condition, the first connector housing 20 and the second connector housing 30 are initially fitted together, and by doing so, the engagement pins 31 is inserted respectively into the inlets 15*a* of the cam grooves 15.

At this time, the two arm plates 12 of the lever 100 located at the starting position are pushed or forced onto the second connector housing 30, and by doing so, the distal end portions of the arm plates 12 is provisionally engaged with the second connector housing 30, and this condition is maintained.

Namely, when the two arm plates 12 are pushed onto the mating connector housing 30 in a direction of arrow C, the provisionally-retaining projection 16 formed on the inner surface of the distal end portion of each arm plate 12 is brought into abutting engagement with the engagement pin 31 of the mating connector housing 30 as shown in FIG. 10. When the two arm plates 12 are further pushed, each engagement pin 31, while elastically bending the arm plate 12 outwardly as indicated by arrow B, slides on the inclined wall 16*b* of the provisionally-retaining projection 16, and subsequently slides over the provisionally-retaining projection 16 (It is said that the provisionally-retaining projection 16 slides over the engagement pin 13.). After the engagement pin 31 thus slides over the provisionally-retaining projection 16, the engagement pin 31 is engaged with the retaining wall 16*a* of the provisionally-retaining projection 16 as shown in FIG. 11, so that the distal end portion of each arm plate 12 is provisionally fixed to the mating second connector housing 30.

By thus effecting the provisionally-fixing operation, the initially-fitted condition of the first and second connector housings 20 and 30 is maintained, and in this condition the engagement pins 31 are received in the inlets 15*a* of the cam grooves 15, respectively.

In this condition, when the interconnecting bar 11 is grasped, and then the lever 100 is pivotally moved toward the operated position, the first connector housing 20 and the second connector housing 30 are fitted together through a cam action achieved by the sliding movement between each cam groove 15 and the engagement pin 31.

When the lever 100 is thus pivotally moved to the operated position, the two connector housings 20 and 30 are properly fitted together, and also the male metal terminals are properly connected respectively to the female metal terminals.

For disconnecting the two connector housings 20 and 30 from each other, the lever 100 is pivotally moved in the opposite direction. As a result, the fitting connection between the two connector housings 20 and 30 is canceled by a reverse cam action effected between each cam groove 15 and the engagement pin 31.

When the lever 100 is thus pivotally moved with the engagement pins 31 kept engaged in the respective cam grooves 15, the cam action achieved by the sliding movement between each cam groove 15 and the engagement pin 31 assists the two connector housings 20 and 30 in fitting connection and disconnection relative to each other, and the connecting and disconnecting operations of the connector are performed with a small force.

Furthermore, in this lever-type connector, the distal end portions of the arm plates 12 are kept provisionally-fixed to the mating connector housing 30, with the engagement pins 31 received in the inlets 15*a* of the respective cam grooves 15. Therefore, once the connector is provisionally assembled, the two connector housings 20 and 30 are prevented from being inadvertently disconnected from each other, and in this provisionally-assembled condition, merely by pivotally moving the lever 100, the two connector housings 20 and 30 are easily connected together by the cam action achieved by the sliding movement between each cam groove 15 and the engagement pin 31.

Furthermore, at the time when the provisionally-fixing operation is effected, the provisionally-retaining projection 16 of each arm plate 12 slides over the engagement pin 31 of the mating connector housing 30 (It is said that the engagement pin 31 slides over the provisionally-retaining projection 16.), and is subsequently retained by the engagement pin 31, and therefore this operation may provide a click feeling for the operator, so that the operator is able to easily confirm whether or not the provisionally-assembling operation is properly carried out.

By the way, even when the arm plates 12 are provisionally fixed to the mating connector housing 30 as described above, there are occasions when this provisionally-fixed condition need to be canceled. In this case, each provisionally-retaining projection 16 slides over the engagement pin 13 while elastically bending each arm plate 12, thereby achieving the provisionally-fixed condition. Therefore, for canceling the provisionally-fixed condition, it is necessary to manually elastically bend each arm plate 12 outwardly so as to cancel the provisional engagement of the provisionally-retaining projection 16 with the engagement pin 31. It is thought that this cancellation operation is effected while the arm plates 12 are elastically bent outwardly away from each other by the use of a jig. However, when the arm plates 12 are elastically bent outwardly away from each other by the jig, it is feared that the engagement pins 31 of the mating connector housing 30 and the lever 100 may be damaged.

In view of the above circumstances, it is an object of this invention to provide a lever-type connector in which the provisionally-fixing of arm plates relative to a mating connector housing is easily canceled without using a jig.

The lever type connector of the first aspect of the invention includes a first connector housing, a second connector housing including a projection, a lever pivotally engaged with the first connector housing and including two arm plates and an interconnecting bar which connects the two arm plates. The each arm plate includes a pivotal support about which the lever pivots, a cam groove including an inlet and an end. The distance between the cam groove and the pivotal support gradually decreases from the inlet to the end, and the projection is inserted into the cam groove through the inlet. The each arm plate also includes a provisional-retaining projection projecting from the arm plate toward the other arm plate, which abuts to the projection and causes to deform the arm plate so that the arm plate recedes to the other arm plate when the projection is inserted into the cam groove through the inlet, and a cancellation lever extending from an edge of the arm plate and positioned at a counter side of the inlet with respect to the pivotal support, which cause to deform the arm plate so that the arm plate recedes to the other arm plate when the cancellation lever is pressed to come close to the other cancellation lever. The projection slides along the cam groove so as to connect the first and the second connector housings when the lever pivot about the shaft hole.

In the connector of the second aspect of the invention, the provisional-retaining projection is adjacent to the inlet and includes an inclined wall to which the projection abuts and slides, and causing to deform the arm plate, and a retaining wall which retains the projection after the projection is inserted into the inlet. The retaining wall is perpendicular to a direction along which the projection abuts to the inclined wall.

In the connector of the third aspect of the invention, the projection is a pin.

In the connector of the fourth aspect of the invention, each cancellation lever includes a anti-slip portion on a surface of a distal end of the cancellation lever, the surface counter directed to the other cancellation lever.

According to the first aspect of the invention, the provisionally-retaining projection for provisional engagement with the projecting portion of the second connector housing is formed at the distal end portion of each arm plate of the lever mounted on the first connector housing. Therefore, by pushing the arm plates of the lever onto the second connector housing so that the provisionally-retaining projections slide respectively over the projecting portions formed on the second connector housing, the distal end portions of the arm plates is provisionally fixed to the second connector housing. At this time, each provisionally-retaining projection slides over the projecting portion of the second connector housing, and is subsequently retained by the projecting portion, and therefore this operation can provide a click feeling to the operator.

In this condition, the engagement pins of the second connector housing are received respectively in the inlets of the cam grooves of the arm plates, and therefore each engagement pin and the cam groove is kept in such a positional relation that the engagement pin and the cam groove isgin to slide relative to each other. Therefore, in this provisionally-fixed condition, by pivotally moving the lever, the two connector housings is fitted together through a cam action achieved by the sliding movement between the cam groove and the engagement pin.

When the provisionally-fixing of the arm plates relative to the second connector housing is to be canceled, the two engagement cancellation lever portions formed on and extending respectively from the two arm plates are pressed inwardly toward each other. As a result, because of the principle of see-saw, the distal end portions of the arm plates facing away respectively from the engagement cancellation lever portions are moved outwardly away from each other with the pivotal support portions serving as fulcrums. Therefore, the provisionally-retaining projections formed respectively on the distal end portions of the arm plates is moved outwardly out of retaining engagement with the respective projecting portions of the second connector housing, and thus the provisional engagement of the provisionally-retaining projections with the respective projecting portions is canceled, and therefore the provisional-fixing of the arm plates relative to the second connector housing is canceled.

In this case, the provisional engagement is canceled merely by pressing the engagement cancellation lever portions inwardly with the fingers, that is, without using any jig, and therefore inadvertent damage to the connector housing and the lever which may be caused by the use of such a jig is avoided.

Furthermore, the provisionally-retaining projection and the engagement cancellation lever portion of each arm plate are disposed respectively at the opposite portions of the arm plate with the pivotal support portion of the lever disposed therebetween, and therefore by manipulating or pressing the engagement cancellation lever portions, the provisionally-retaining projections is easily displaced outwardly away from each other because of leverage. Therefore, the high provisionally-retaining force is obtained by the provisionally-retaining projections while the force required for canceling the provisionally-retained condition is kept to a low level.

According to the second aspect of the invention, the inclined wall and the retaining wall are formed respectively on the outer and inner surfaces of the provisionally-retaining projection, and therefore merely by pushing the arm plates onto the mating second connector housing, the provisionally-retaining projections is easily engaged respectively with the projecting portions of the mating second connector housing while the arm plates are elastically bent outwardly away from each other.

According to the third aspect of the invention, the engagement pin is used as the projecting portion, and therefore any additional special projecting portion for provisionally-fixing purposes does not need to be provided, and therefore the construction is simplified.

According to the fourth aspect of the invention, the anti-slip portions are formed respectively on the outer surfaces of the distal end portions of the engagement cancellation lever portions, and therefore the operation for canceling the provisional fixing of the arm plates relative to the mating second connector housing is easily and positively carried out.

DETAILED DESCRIPTION OF EXEMPLARY EMBODIMENTS OF THE PRESENT INVENTION

An exemplary embodiment of the present invention will now be described with reference to the drawings.

Figure 1:
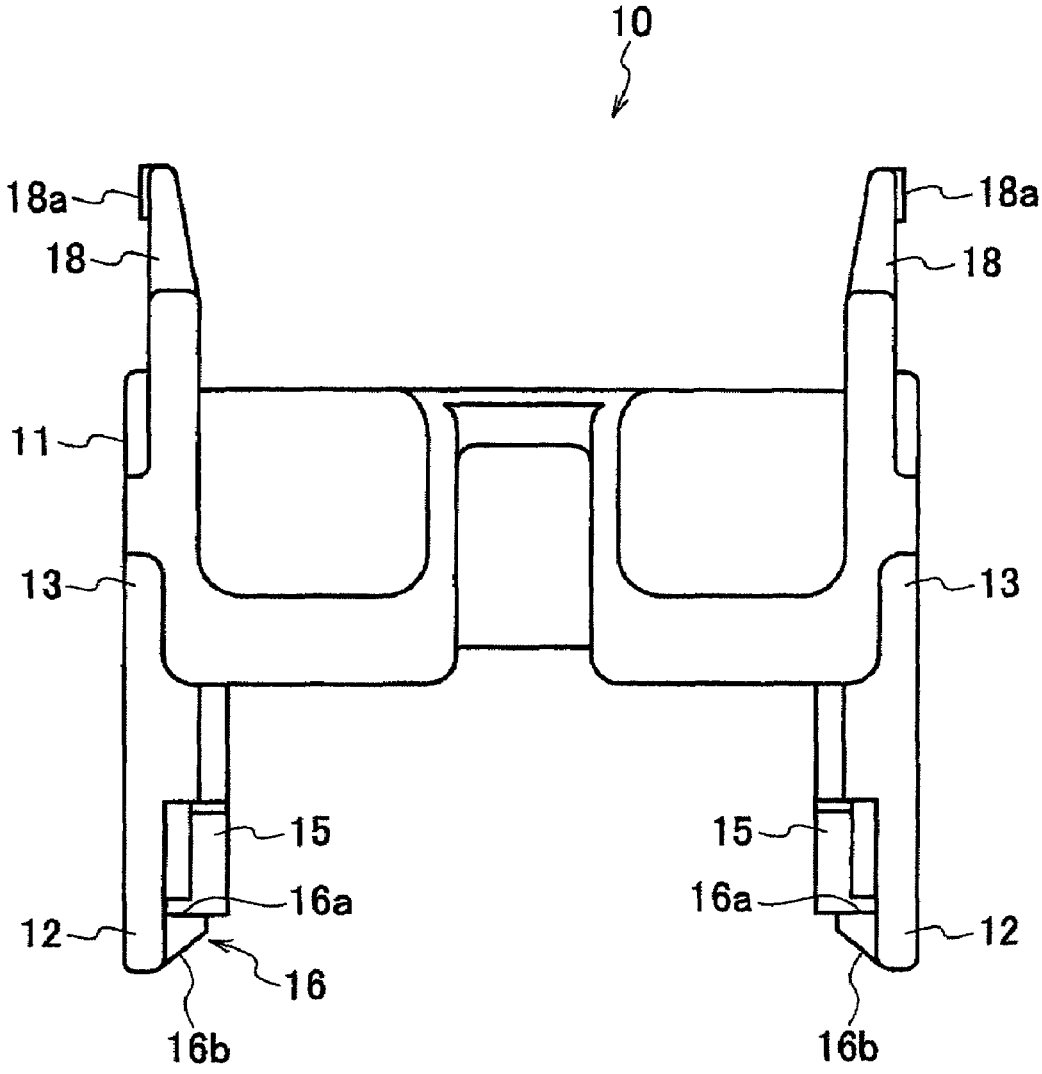
FIG. 1 is a front-elevational view of a lever used in one exemplary embodiment of a lever-type connector of the present invention.
Figure 2A:
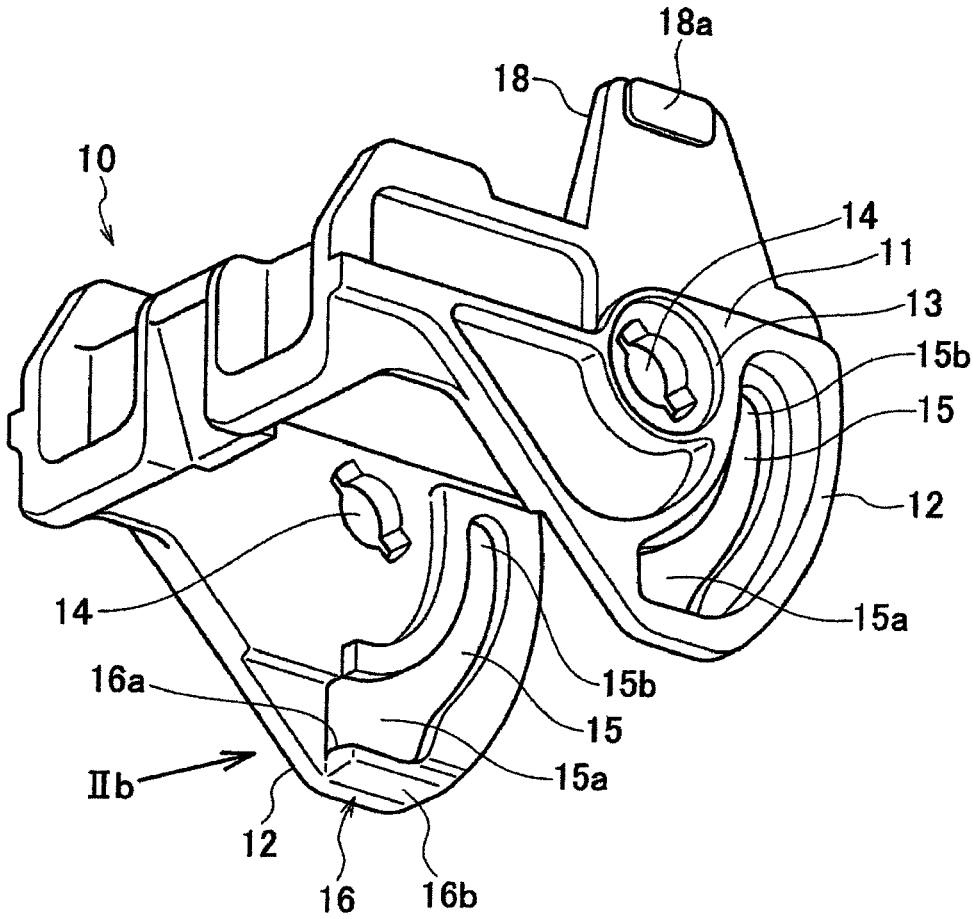
FIG. 2A is a perspective view showing the construction of the lever.
Figure 2B:
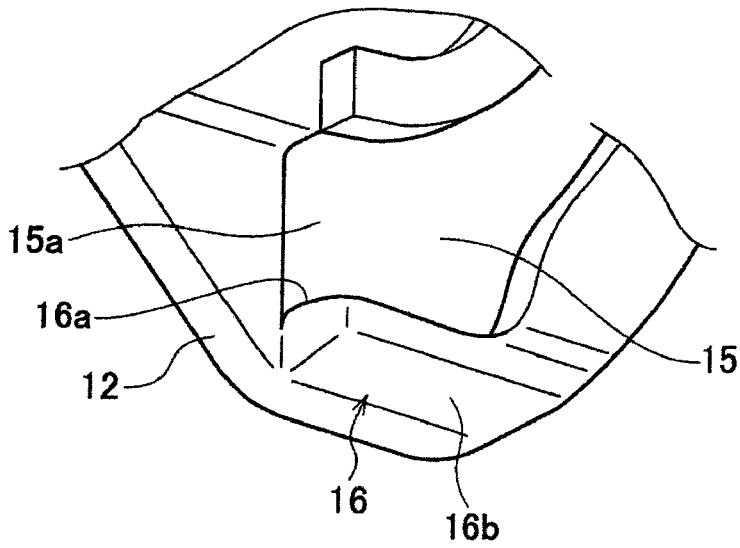
FIG. 2B is an enlarged view of a portion indicated by arrow IIb of FIG. 2A.
Figure 3:
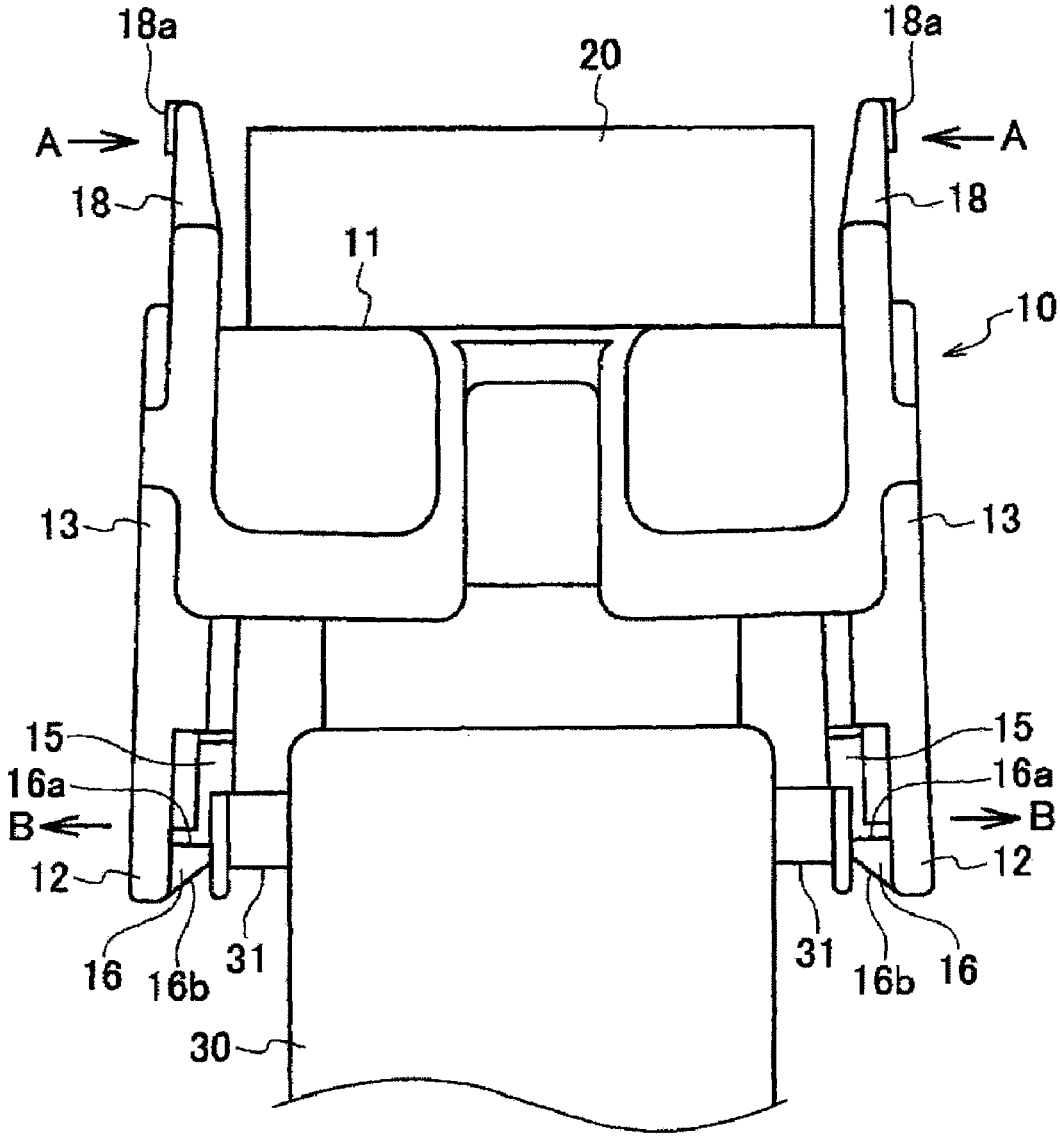
FIG. 3 is a front-elevational view showing the process of canceling the provisional fixing of distal end portions of arm plates relative to a mating connector housing.
Figure 4:
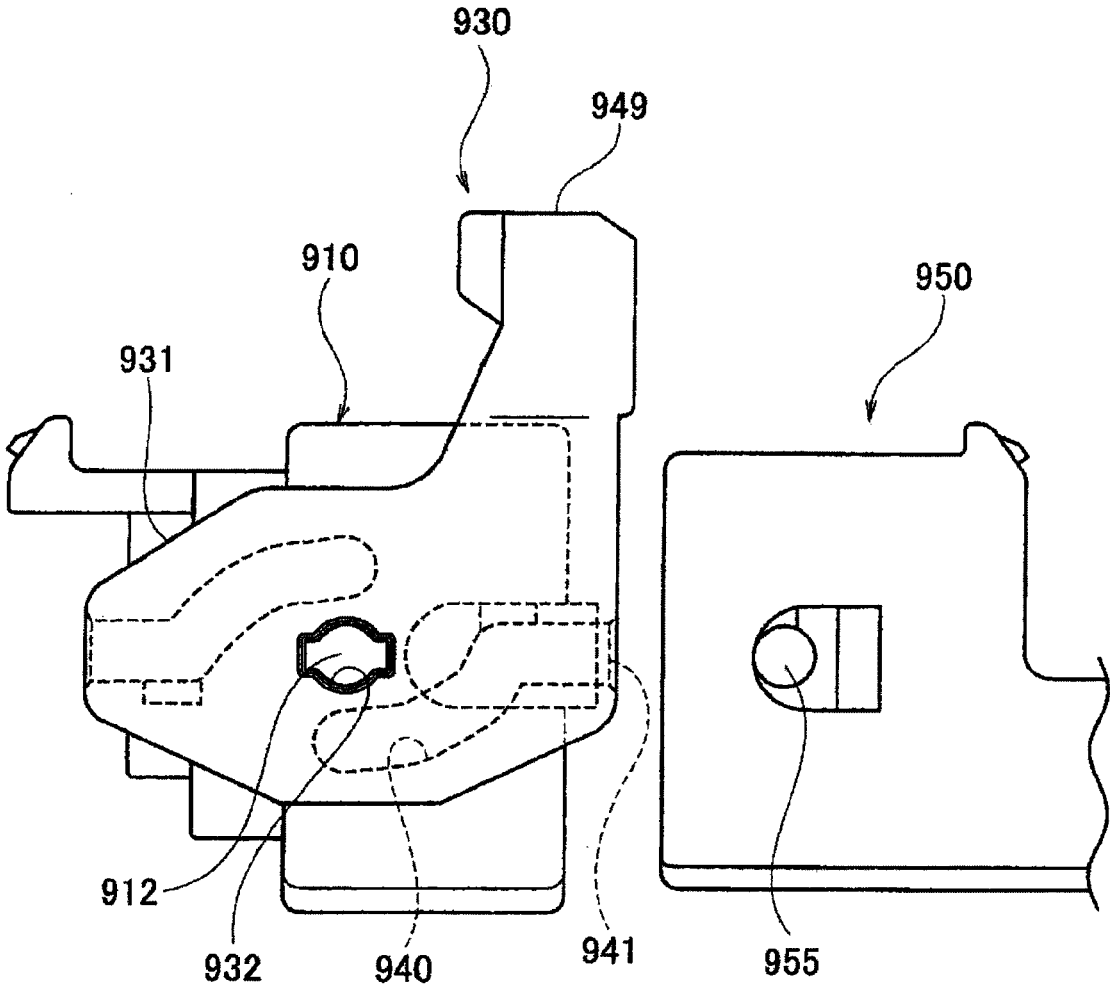
FIG. 4 is a side-elevational view of a related lever-type connector, showing a condition before each engagement pin is inserted into a cam groove.
Figure 5:
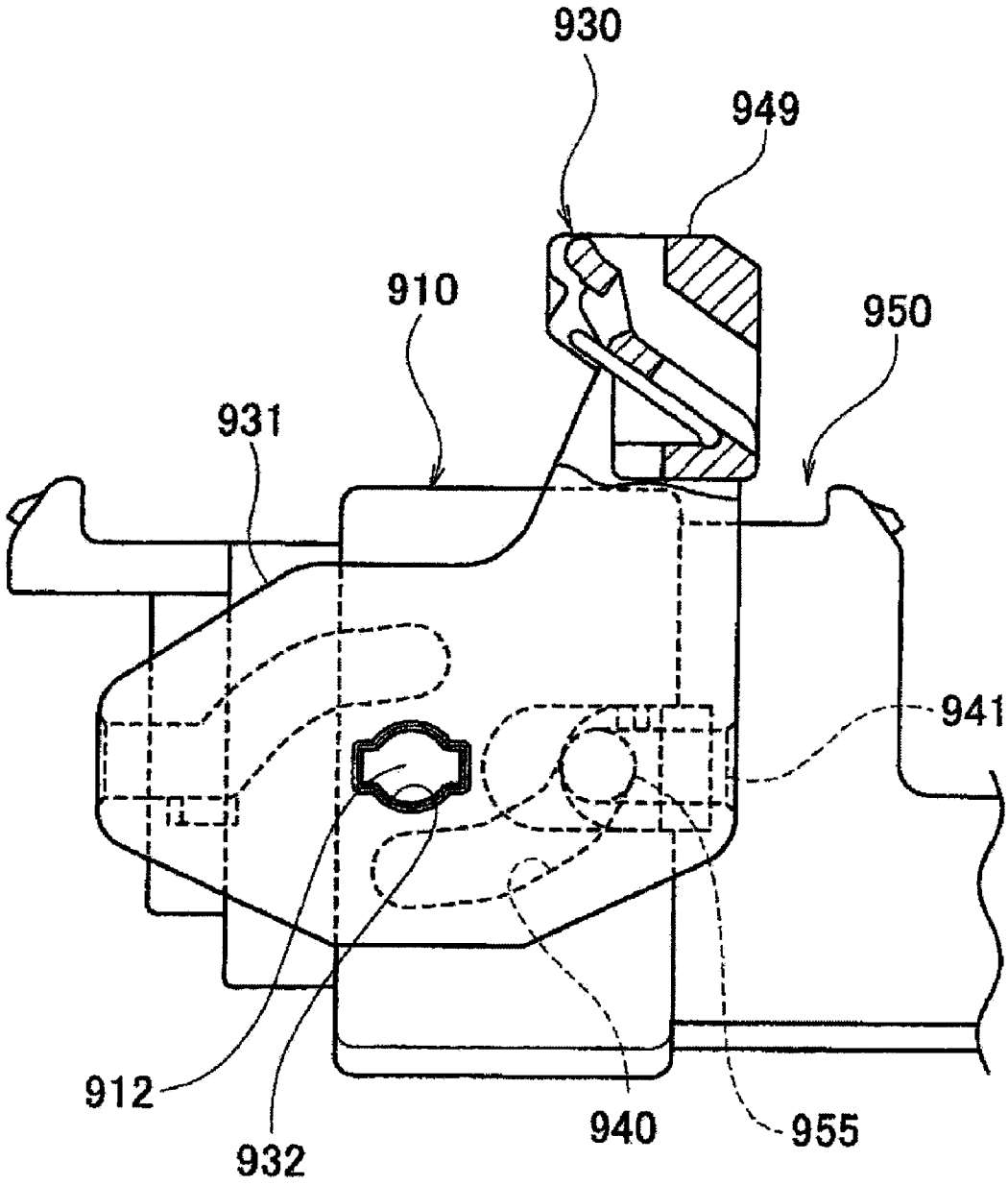
FIG. 5 is a side-elevational view of the connector of FIG. 4, showing a condition (initially-fitted condition) in which the engagement pin is initially inserted in the cam groove.
Figure 6:
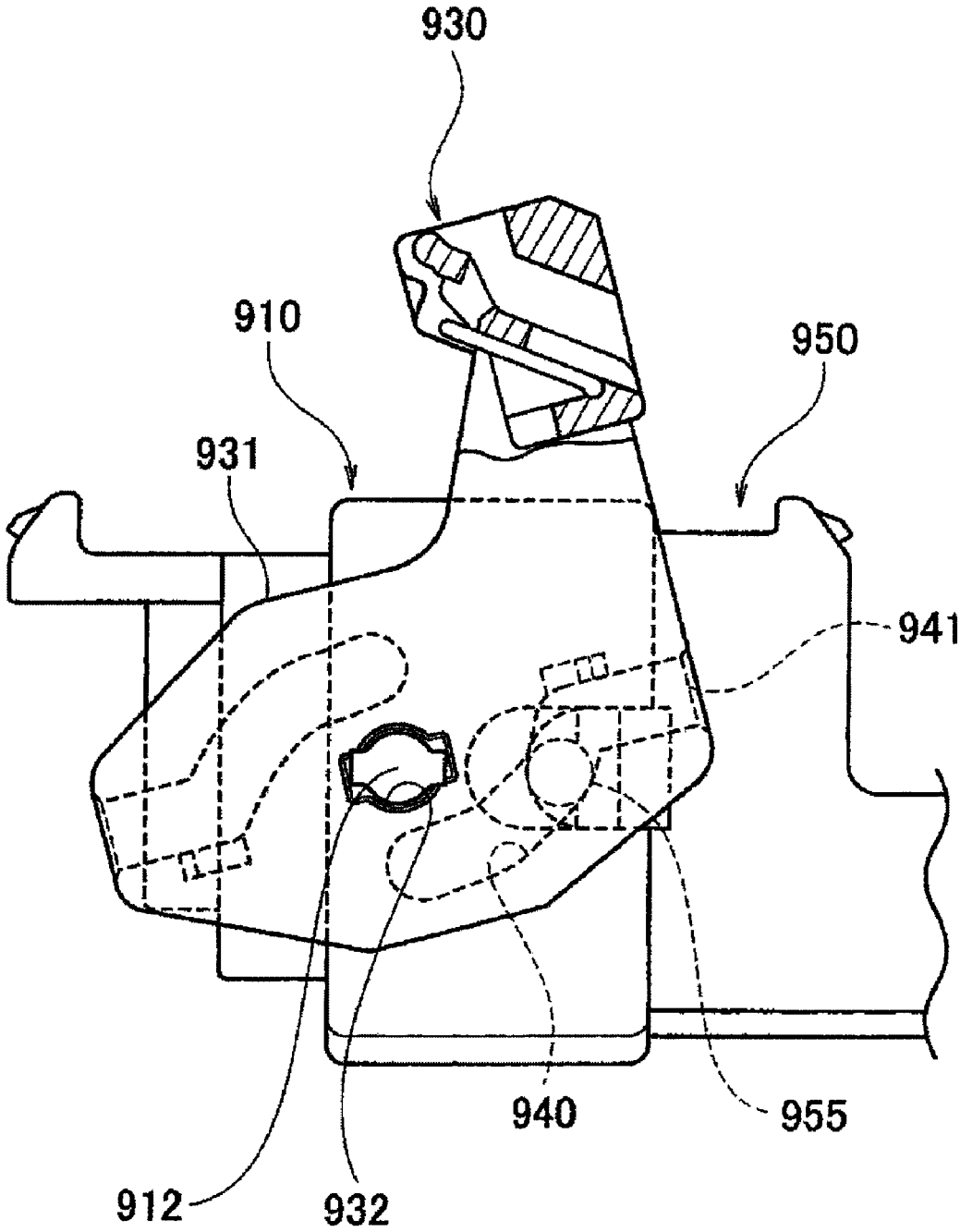
FIG. 6 is a side-elevational view of the connector of FIG. 4, showing a condition in which a lever is initially pivotally moved.
Figure 7:
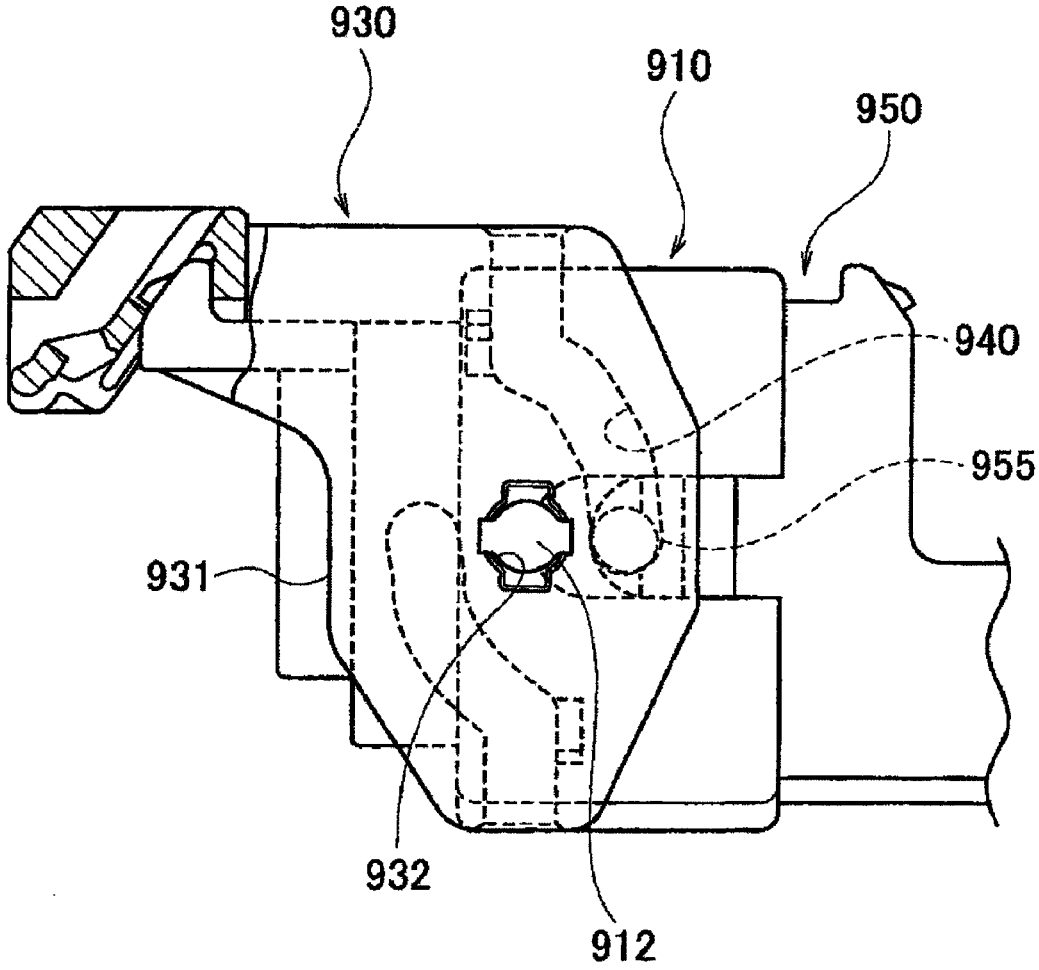
FIG. 7 is a side-elevational view of the connector of FIG. 4, showing a condition (finally-fitted condition) in which the lever is pivotally moved to a operated position.
Figure 8:
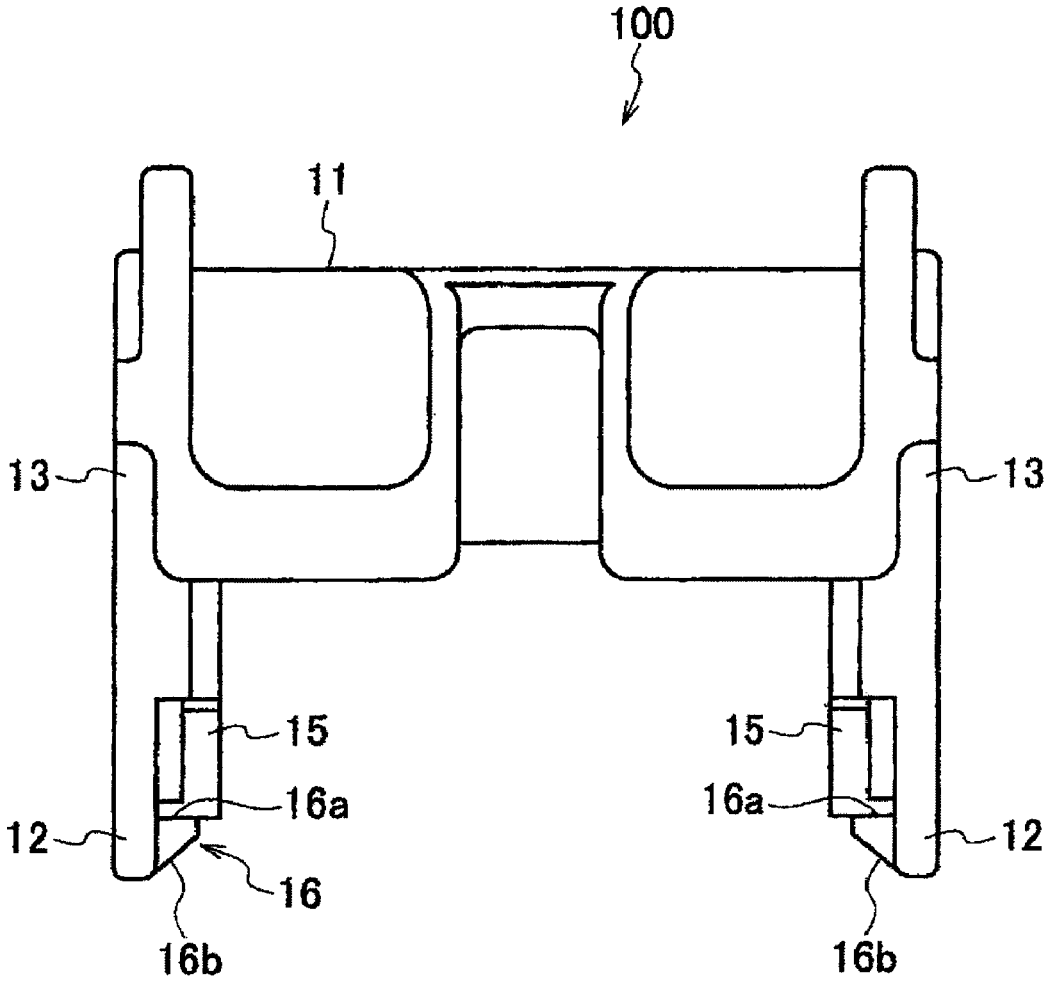
FIG. 8 is a front-elevational view showing the construction of an improved lever of a lever-type connector.
Figure 9A:
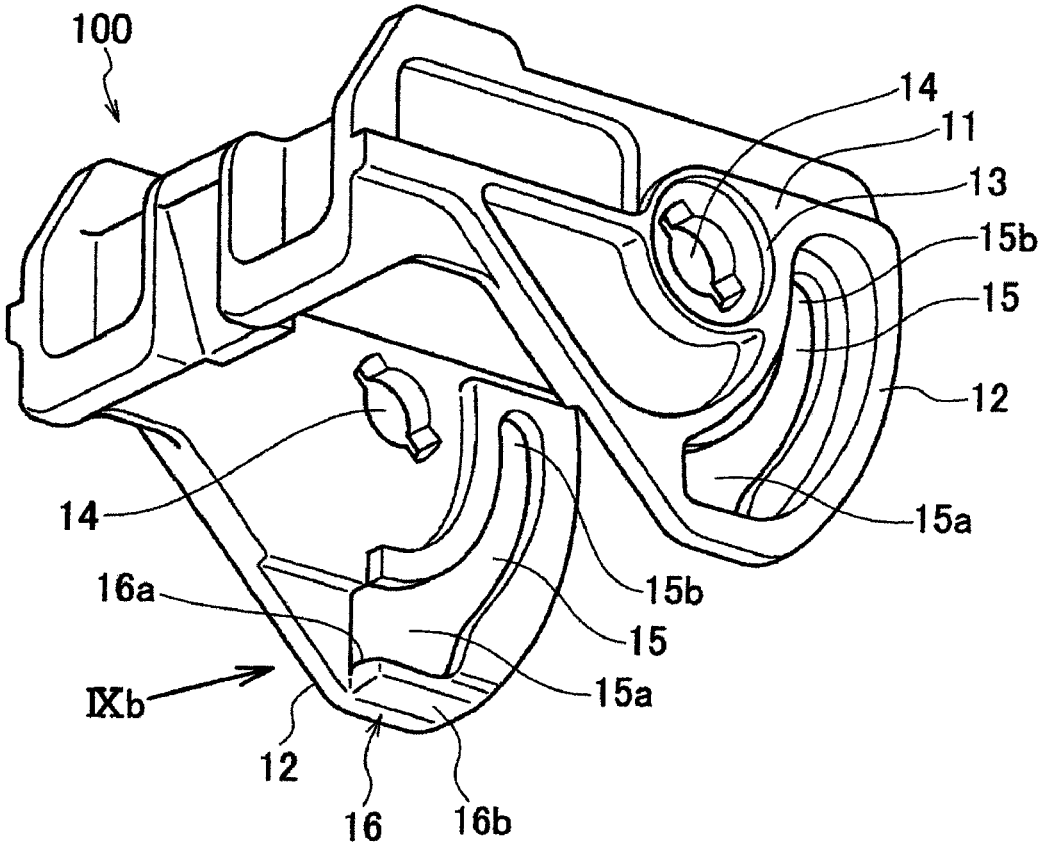
FIG. 9A is a perspective view showing the construction of the lever of FIG. 8.
Figure 9B:
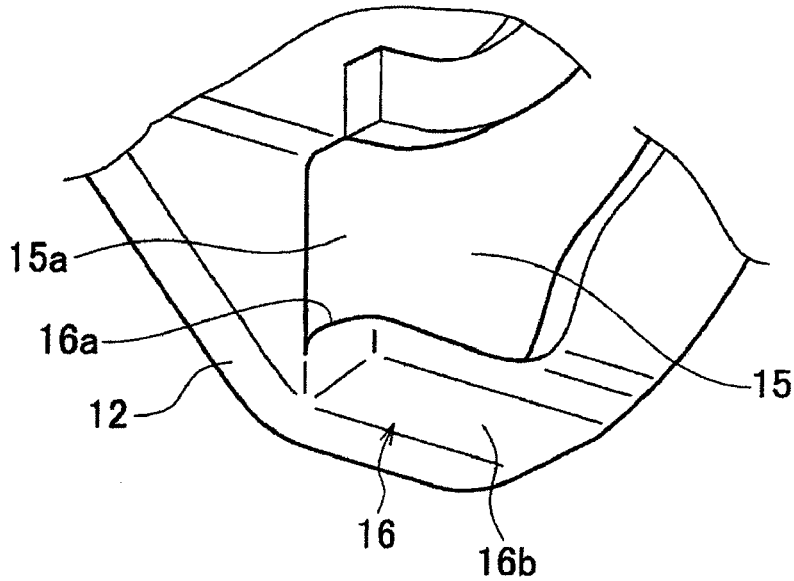
FIG. 9B is an enlarged view of a portion of the lever indicated by IXb of FIG. 9A.
Figure 10:
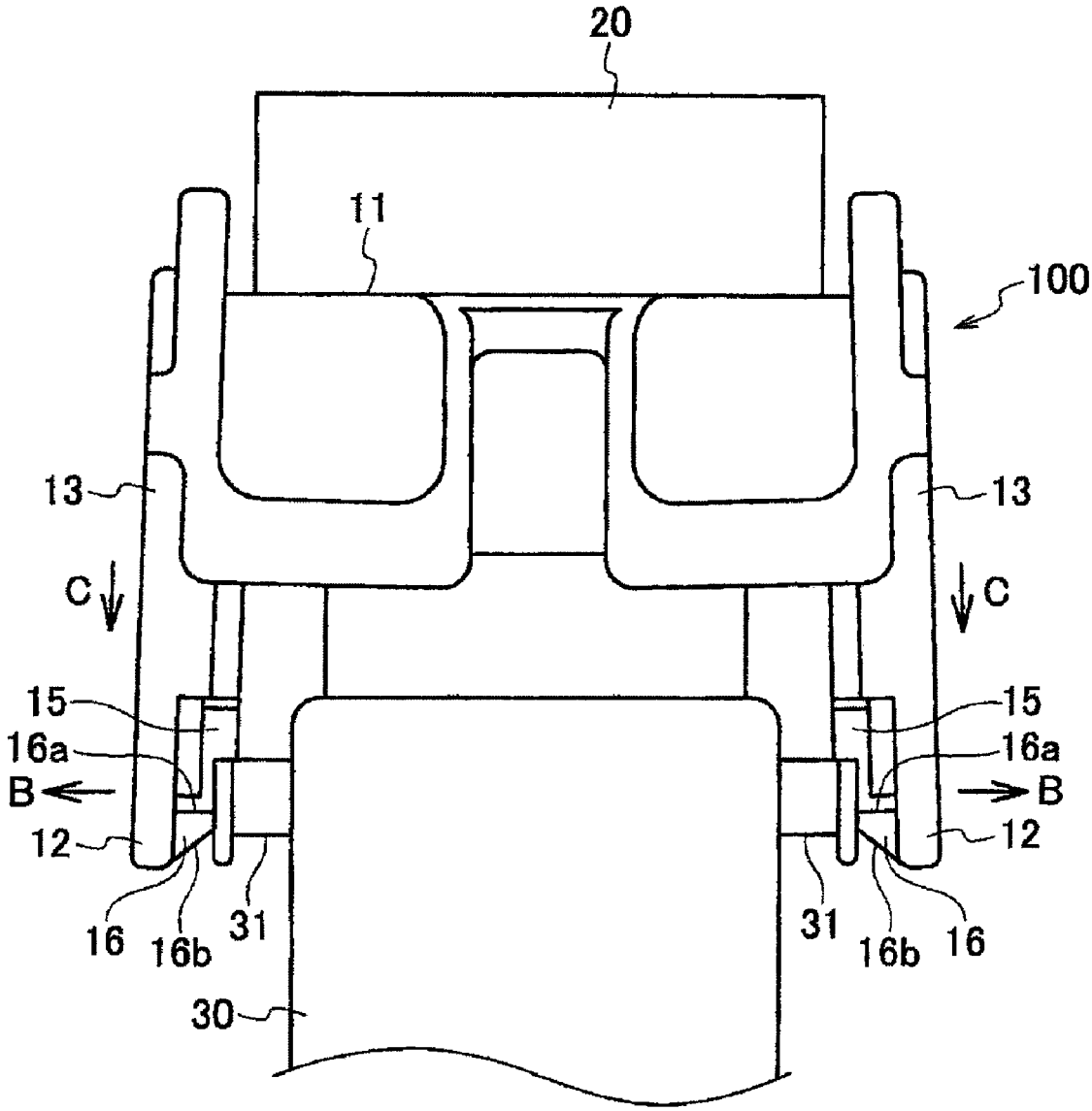
FIG. 10 is a front-elevational view of the connector of FIG. 8, showing the process of provisionally engaging distal end portions of arm plates of the lever (mounted on a first connector housing of the connector of FIG. 8) respectively with engagement pins of a mating second connector housing.
Figure 11:
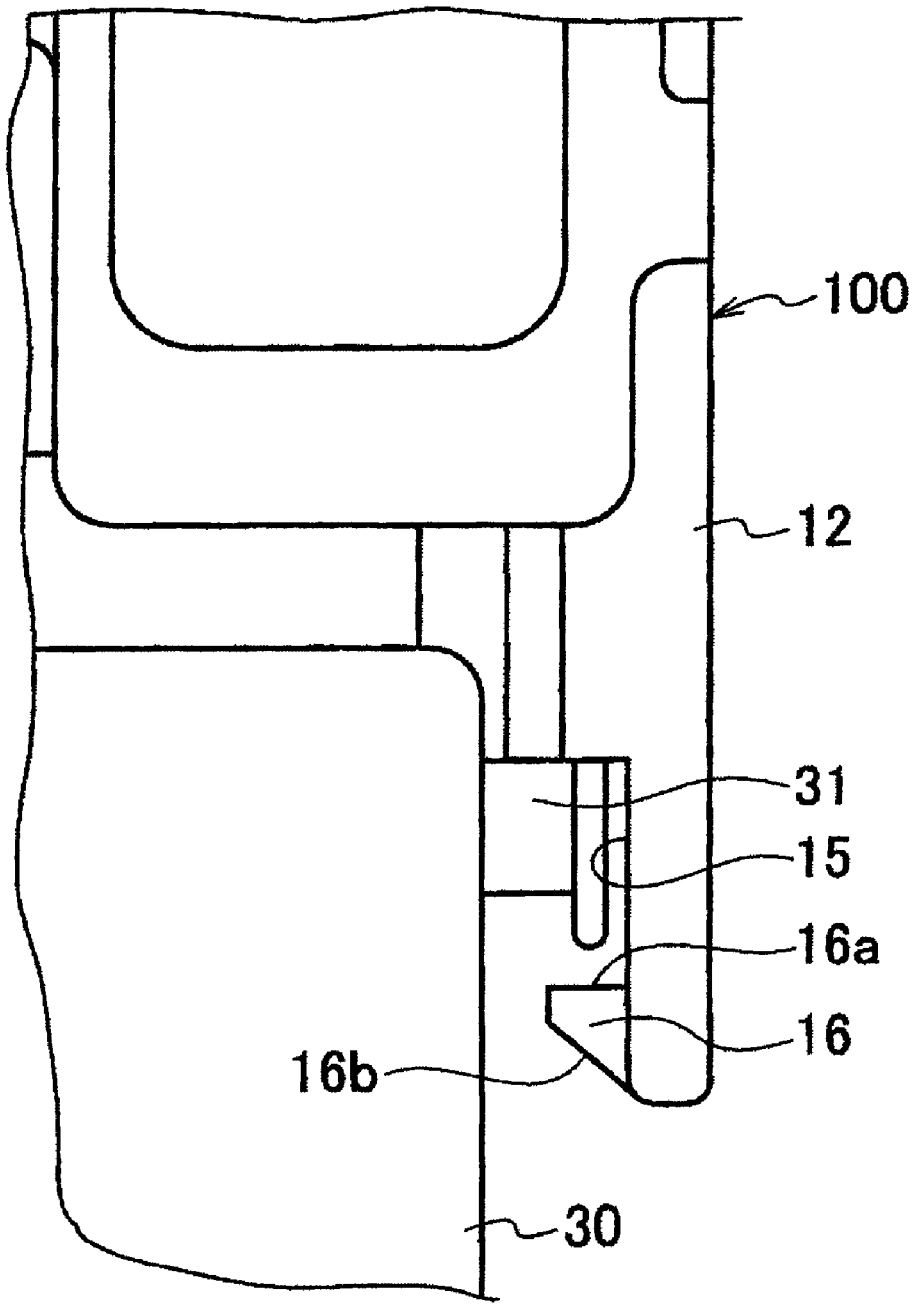
FIG. 11 is a fragmentary enlarged view of the connector of FIG. 8, showing a condition in which the arm plate is provisionally engaged with the engagement pin.

FIG. 1 is a front-elevational view of a lever used in one exemplary embodiment of a lever-type connector of the invention, FIG. 2A is a perspective view showing the construction of the lever, FIG. 2B is an enlarged view of a portion indicated by arrow IIb of FIG. 2A, and FIG. 3 is a front-elevational view showing the process of canceling the provisional fixing of distal end portions of arm plates relative to a mating connector housing.

As shown in FIG. 1, this lever-type connector comprises a pair of female and male (or first and second) connector housings 20 and 30 to be fitted together, and female metal terminals (not shown) are received respectively in terminal cavities of the first connector housing 20, and also male metal terminals (not shown) are received respectively in terminal cavities of the second connector housing 30.

The lever 10 of a generally U-shaped cross-section for effecting the fitting operation of the connector is mounted on outer side surfaces of the first connector housing 20. The lever 10 includes a pair of right and left arm plates 12 and 12 each having at its one end portion a pivotal support portion 13 for being pivotally supported on the first connector housing 20, and an interconnecting bar (handle) 11 interconnecting the other ends of the two arm plates 12. A shaft hole 14 is formed through a center portion of the pivotal support portion 13 of each arm plate 12, and a cam groove 15 is formed in the arm plate 12, and is disposed around the shaft hole 14.

The cam groove 15 is formed around the shaft hole 14 formed in the center portion of the pivotal support portion 13, and extends through a predetermined angle, and is curved such that the distance from the center (serving as the axis of pivotal movement of the lever) of the shaft hole 14 to the cam groove 15 is gradually decreasing from an inlet 15*a* of the cam groove 15 toward a terminating end (inner end) 15*b* of the cam groove 15.

Support shafts (not shown) for being angularly movably fitted in the respective shaft holes 14 are formed on and project respectively from the outer side surfaces of the first connector housing 20. When the shaft holes 14 are fitted respectively on the support shafts, the lever 10 is pivotally moved about the pivotal support portions 13 through the predetermined angle between a starting position and a operated position.

Engagement pins 31 for fitting respectively in the cam grooves 15 of the lever 10 are formed on and project respectively from outer right and left side surfaces of the mating second connector housing 30. The lever-type connector is once provisionally assembled, and in this condition each engagement pin 31 is located immediately before (or adjacent to) the inlet 15*a* of the cam groove 15 of the lever 10 disposed at the starting position.

In this lever-type connector, provisionally-retaining projections 16 are formed respectively on inner surfaces of distal end portions of the two arm plates 12 of the lever 10, and each provisionally-retaining projection 16 can slide over the corresponding engagement pin (projecting portion) 31 (formed on the second connector housing 30) because of outward elastic deformation (bending) of the arm plate 12, and is provisionally engaged with the engagement pin 31, with the engagement pin 31 received in the inlet 15*a* of the cam groove 15, thereby provisionally fixing the arm plate 12 to the second connector housing 30.

The provisionally-retaining projection 16 is formed on and projects from that portion of the inner surface of the distal end portion of the arm plate 12 disposed adjacent to the inlet 15*a* of the cam groove 15. An inclined wall (or surface) 16*b* is formed on an outer surface of each provisionally-retaining projection 16, and as the two arm plates 12 are pushed or forced onto the second connector housing 30, the inclined wall 16*b* slides on the engagement pin 31 of the second connector housing 30 to elastically bend the arm plate 12 outwardly. A retaining wall (or surface) 16*a* for retaining the engagement pin 31 slid over the provisionally-retaining projection 16 is formed on an inner surface of the provisionally-retaining projection 16, the retaining wall 16*a* being disposed generally perpendicular to the direction of pushing of the arm plates 12 onto the second connector housing 30.

An engagement cancellation lever portion 18 is formed on and extends from that portion (or that side) of each arm plate 12 which is opposite to (or facing away from) the distal end portion of the arm plate 12 having the provisionally-retaining projection 16, with the pivotal support portion 13 disposed therebetween, and when the engagement cancellation lever portions 18 of the two arm plates 12 are pressed to be displaced inwardly toward each other as indicated by arrows A in FIG. 3, the distal end portions of the arm plates 12, each having the provisionally-retaining projection 16, are displaced outwardly away from each other as indicated by arrows B, thereby canceling the provisional engagement of the provisionally-retaining projections 16 with the respective engagement pins 13. An anti-slip portion 18*a* for preventing the finger from slipping when holding the engagement cancellation lever portion 18 is formed on an outer surface of a distal end portion of the engagement cancellation lever portion 18.

For fitting the two connector housings together, first, the lever 10 is located at the starting position. Then, in this condition, the first connector housing 20 and the second connector housing 30 are initially fitted together, and by doing so, the engagement pins 31 is inserted respectively in the inlets 15*a* of the cam grooves 15.

At this time, the two arm plates 12 of the lever 10 located at the starting position are pushed or forced onto the mating connector housing 30, and by doing so, the distal end portions of the arm plates 12 is provisionally engaged with the mating connector housing 30, and this condition is maintained.

Namely, when the two arm plates 12 are pushed onto the mating connector housing 30, the provisionally-retaining projection 16 formed on the inner surface of the distal end portion of each arm plate 12 is brought into abutting engagement with the engagement pin 31 of the mating connector housing 30. When the two arm plates 12 are further pushed, each engagement pin 31, while elastically bending the arm plate 12 outwardly, slides on the inclined wall 16*b* of the provisionally-retaining projection 16, and subsequently slides over the provisionally-retaining projection 16 (It is said that the provisionally-retaining projection 16 slides over the engagement pin 13.). After the engagement pin 31 thus slides over the provisionally-retaining projection 16, the engagement pin 31 is engaged with the retaining wall 16*a* of the provisionally-retaining projection 16, so that the distal end portion of each arm plate 12 is provisionally fixed to the mating second connector housing 30.

By thus effecting the provisionally-fixing operation, the initially-fitted condition of the first and second connector housings 20 and 30 is maintained, and in this condition the engagement pins 31 are received in the inlets 15*a* of the cam grooves 15, respectively.

In this condition, when the interconnecting bar 11 is grasped, and then the lever 10 is pivotally moved toward the operated position, the first connector housing 20 and the second connector housing 30 are fitted together through a cam action achieved by the sliding movement between each cam groove 15 and the engagement pin 31.

When the lever 10 is thus pivotally moved to the operated position, the two connector housings 20 and 30 are properly fitted together, and also the male metal terminals are properly connected respectively to the female metal terminals.

For disconnecting the two connector housings 20 and 30 from each other, the lever 10 is pivotally moved in the opposite direction. As a result, the fitting connection of the two connector housings 20 and 30 with each other is canceled by a reverse cam action effected between each cam groove 15 and the engagement pin 31.

When the lever 10 is thus pivotally moved with the engagement pins 31 kept engaged in the respective cam grooves 15, the cam action achieved by the sliding movement between each cam groove 15 and the engagement pin 31 assists the two connector housings 20 and 30 in fitting connection and disconnection relative to each other, and the fitting and disconnecting operations of the connector is effected with a small force.

Furthermore, in this lever-type connector, the distal end portions of the arm plates 12 is kept provisionally-fixed to the mating connector housing 30, with the engagement pins 31 received in the inlets 15*a* of the respective cam grooves 15. Therefore, once the connector is provisionally assembled, the two connector housings 20 and 30 will not be inadvertently disconnected from each other, and in this provisionally-assembled condition, merely by pivotally moving the lever 10, the two connector housings 20 and 30 is easily fitted together by the cam action achieved by the sliding movement between each cam groove 15 and the engagement pin 31.

Furthermore, at the time when the provisionally-fixing operation is effected, the provisionally-retaining projection 16 of each arm plate 12 slides over the engagement pin 31 of the mating connector housing 30 (It is said that the engagement pin 31 slides over the provisionally-retaining projection 16.), and is subsequently retained by the engagement pin 31, and therefore this operation can provide a click feeling to the operator, so that the operator can easily confirm whether or not the provisionally-assembling operation has been properly carried out.

When the provisionally-fixing of the arm plates 12 relative to the mating connector housing 30 is to be canceled, the two engagement cancellation lever portions 18 formed on and extending from the lever 10 are pressed to be displaced inwardly toward each other with the fingers. As a result, because of the principle of see-saw, the distal end portions of the arm plates 12 facing away respectively from the engagement cancellation lever portions 18 are turned or displaced outwardly away from each other, with the pivotal support portions 13 serving as fulcrums.

Therefore, the provisionally-retaining projections 16 formed respectively on the distal end portions of the arm plates 12 is moved outwardly out of retaining engagement with the respective engagement pins 31, and thus the provisional engagement of the provisionally-retaining projections 16 with the respective engagement pins 31 is canceled, and therefore the provisional-fixing of the arm plates 12 relative to the mating connector housing 30 is canceled.

In this case, the provisional engagement is canceled merely by pressing the engagement cancellation lever portions 18 inwardly with the fingers, that is, without using any jig, and therefore inadvertent damage to the connector housing 30 and the lever 10 which may be caused by the use of such a jig is avoided.

Furthermore, the provisionally-retaining projection 16 and the engagement cancellation lever portion 18 of each arm plate 12 are disposed respectively at the opposite portions of the arm plate 12 with the pivotal support portion 13 of the lever 10 disposed therebetween, and therefore by manipulating or pressing the engagement cancellation lever portions 18, the provisionally-retaining projections 16 is easily displaced outwardly away from each other because of leverage. Therefore, the high provisionally-retaining force is obtained by the provisionally-retaining projections 16 while the force required for canceling the provisionally-retained condition is kept to a low level.

Furthermore, the inclined wall 16*b* and the retaining wall 16 are formed respectively on the outer and inner surfaces of each provisionally-retaining projection 16, and therefore merely by pushing the arm plates 12 onto the mating connector housing 30, the provisionally-retaining projections 16 is easily engaged respectively with the engagement pins 31 of the mating connector housing 30 while the arm plates 12 are elastically bent outwardly away from each other.

Furthermore, the anti-slip portions 18*a* are formed respectively on the outer surfaces of the distal end portions of the engagement cancellation lever portions 18, and therefore the operation for canceling the provisional fixing of the arm plates 12 relative to the mating connector housing 30 is easily and positively carried out.

Furthermore, in the lever-type connector of this embodiment, the engagement pin 31 is used as the projecting portion with which the provisionally-retaining projection 16 of the arm plate 12 is adapted to be provisionally engaged, and therefore any additional special projecting portion for provisionally-fixing purposes does not need to be provided, and therefore the construction is simplified.

In the above embodiment, the engagement pins 31 are used as the respective projecting portions with which the provisionally-retaining projections 16 of the arm plates 12 are adapted to be provisionally engaged, respectively. However, in addition to the engagement pins 31, projecting portions for provisionally-retaining purposes is provided on the mating connector 30.

The invention claimed is:

1. A lever type connector comprising:

a first connector housing;

a second connector housing including a projection and a pin; and a lever pivotally engaged with the first connector housing and including two arm plates and an interconnecting bar which connects the two arm plates, wherein the each arm plate comprises:

a pivotal support about which the lever pivots;

a cam groove including an inlet and an end wherein a distance between the cam groove and the pivotal support gradually decreases from the inlet to the end, and the pin is inserted into the cam groove through the inlet;

a provisional-retaining projection projecting from the arm plate toward the other arm plate, which abuts to the projection and causes to deform the arm plate so that the arm plate recedes to the other arm plate when the pin is inserted into the cam groove through the inlet; and a cancellation lever extending from an edge of the arm plate and positioned at a counter side of the inlet with respect to the pivotal support wherein the cancellation lever causes to deform the arm plate so that the arm plate recedes to the other arm plate when the cancellation lever of the arm plate is pressed to come close to the cancellation lever of the other arm plate, wherein the pin slides along the cam groove so as to connect the first and the second connector housings when the lever pivot about the pivotal support.

2. The connector according to claim 1, wherein the provisional-retaining projection is adjacent to the inlet and includes:

an inclined wall to which the projection abuts and slides, and causing to deform the arm plate; and a retaining wall which retains the projection, wherein the retaining wall is perpendicular to a direction along which the projection abuts to the inclined wall.

3. The connector according to claim 1, wherein the projection is the pin.

4. The connector according to claim 2, wherein the projection is the pin.

5. The connector according to claim 1, wherein each cancellation lever includes a anti-slip portion on a surface of a distal end of the cancellation lever, the surface counter directed to the other cancellation lever.

6. The connector according to claim 2, wherein each cancellation lever includes a anti-slip portion on a surface of a distal end of the cancellation lever, the surface counter directed to the other cancellation lever.

7. The connector according to claim 3, wherein each cancellation lever includes a anti-slip portion on a surface of a distal end of the cancellation lever, the surface counter directed to the other cancellation lever.

8. The connector according to claim 1, wherein the lever has a substantially U-shape.

9. A lever comprising:

two arm plates, each of which comprises:

a pivotal support about which the lever pivots;

a cam groove including an inlet and an end wherein a distance between the cam groove and the pivotal support gradually decreases from the inlet to the end;

a provisional-retaining projection which is adjacent to the inlet and projects from the arm plate toward the other arm plate; and a cancellation lever extending from an edge of the arm plate and positioned at a counter side of the inlet with respect to the pivotal support, wherein the cancellation lever cause to deform the arm plate so that the arm plate recedes to the other arm plate when the cancellation lever of the arm plate is pressed to come close to the cancellation lever of the other arm plate; and an interconnecting bar which connects the two arm plates.

* * * * *